US008439478B2

(12) United States Patent
Kanata et al.

(10) Patent No.: US 8,439,478 B2
(45) Date of Patent: May 14, 2013

(54) INK-JET WIPING APPARATUS, AND WIPING METHOD USING THIS

(75) Inventors: Yoshio Kanata, Nara (JP); Masahiro Muro, Osaka (JP)

(73) Assignee: Panasonic Corporation, Osaka (JP)

( * ) Notice: Subject to any disclaimer, the term of this patent is extended or adjusted under 35 U.S.C. 154(b) by 270 days.

(21) Appl. No.: 12/890,932

(22) Filed: Sep. 27, 2010

(65) Prior Publication Data

US 2011/0074869 A1 Mar. 31, 2011

(30) Foreign Application Priority Data

Sep. 28, 2009 (JP) ..... 2009-222223
Aug. 9, 2010 (JP) ..... 2010-178901

(51) Int. Cl.
*B41J 2/165* (2006.01)

(52) U.S. Cl.
USPC ..... 347/25

(58) Field of Classification Search ..... 347/25
See application file for complete search history.

(56) References Cited

U.S. PATENT DOCUMENTS

| | | | | |
|---|---|---|---|---|
| 4,908,636 | A | 3/1990 | Saito et al. | |
| 4,970,535 | A | 11/1990 | Oswald et al. | |
| 5,490,300 | A | 2/1996 | Horn | |
| 7,552,503 | B2 * | 6/2009 | Wakao et al. | 15/302 |
| 2005/0044653 | A1 | 3/2005 | Wakao et al. | |

FOREIGN PATENT DOCUMENTS

| | | |
|---|---|---|
| JP | 63-242643 | 10/1988 |
| JP | 2-108549 | 4/1990 |
| JP | 8-243469 | 9/1996 |
| JP | 2000-62197 | 2/2000 |
| JP | 2004-90361 | 3/2004 |
| JP | 2005-034782 | 2/2005 |
| JP | 2005-169730 | 6/2005 |

OTHER PUBLICATIONS

Japan Office action, mail date is Aug. 23, 2011.

* cited by examiner

*Primary Examiner* — Kevin S Wood
(74) *Attorney, Agent, or Firm* — Greenblum & Bernstein, P.L.C.

(57) ABSTRACT

A wiping apparatus having a gas injection aperture that injects gas, and a guide section that has a convexly curved surface and has an apex and over which gas injected from the gas injection aperture is blown, and, in this wiping apparatus, foreign substance adhering to a nozzle plate of an ink-jet head placed above the guide section is blown away by gas guided along the curved surface of the guide section.

15 Claims, 13 Drawing Sheets

INK-JET WIPING APPARATUS, AND WIPING METHOD USING THIS

CROSS REFERENCE TO RELATED APPLICATIONS

This application is entitled to and claims the benefit of Japanese Patent Application No. 2009-222223, filed on Sep. 28, 2009 and Japanese Patent Application No. 2010-178901, filed on Aug. 9, 2010, the disclosures of which including the specification, drawings and abstract is incorporated herein by reference in its entirety.

TECHNICAL FIELD

The present invention relates to a wiping apparatus for an ink-jet head, and a wiping method for removing foreign substance such as ink adhering to a nozzle plate of an ink-jet head using the wiping apparatus.

BACKGROUND ART

In recent years, a method of applying ink containing a functional material using an ink-jet head has been widely adopted in the manufacture of electronic devices. An ink-jet head discharges ink toward material to which ink is to be applied, via an extremely small aperture (nozzle) provided in a nozzle plate.

With an ink-jet head of this configuration, when ink is discharged from a nozzle, part of the ink or foreign substance such as dust in the air may adhere to the nozzle plate. If foreign substance adheres to the nozzle plate, ink cannot be discharged from a nozzle appropriately, and accurate ink application cannot be performed.

Thus, a printing apparatus having an ink-jet head is normally provided with a wiping apparatus for removing foreign substance adhering to the nozzle plate (see Patent Literature 1, for example). A wiping apparatus that blows gas at an angle to the nozzle plate is known as a wiping apparatus for removing foreign substance (see Patent Literature 2 through 4, for example).

FIG. 1A is a perspective view of a wiping apparatus disclosed in Patent Literature 2, and FIG. 1B is a cross-sectional view of the wiping apparatus shown in FIG. 1A in the process of wiping nozzle plate 11 of ink-jet head 10. Also, FIG. 2 is a cross-sectional view of a wiping apparatus disclosed in Patent Literature 3 in the process of wiping nozzle plate 11 of ink-jet head 10.

As shown in FIG. 1A, FIG. 1B, and FIG. 2, wiping apparatuses disclosed in Patent Literature 2 and Patent Literature 3 have gas injection aperture 130 that injects gas, and gas suction aperture 150 that sucks in gas. Also, as shown in FIG. 1B and FIG. 2, wiping apparatuses disclosed in Patent Literature 2 and Patent Literature 3 inject gas from gas injection aperture 130 at an angle to nozzle plate 11, and blow away foreign substance adhering to nozzle plate 11. Then the foreign substance that is blown away is sucked in by gas suction aperture 150 to prevent it from being scattered about.

However, when gas is injected at an angle from gas injection aperture 130 as in the wiping apparatuses disclosed in Patent Literature 2 and Patent Literature 3, gas is injected toward the inside of nozzle aperture 13 of nozzle plate 11. When gas is injected toward the inside of nozzle aperture 13, drying of ink 15 inside nozzle aperture 13 is accelerated. As a consequence, nozzle aperture 13 becomes clogged, and ink cannot be discharged from nozzle aperture 13.

A technology is known to inject gas parallel to nozzle plate 11 from gas injection aperture 130, as shown in FIG. 3A and FIG. 3B (see Patent Literature 2, for example), in order to prevent gas from being directed toward the inside of a nozzle aperture.

Furthermore, wiping apparatuses are also known (see Patent Literature 5 through 7, for example) that utilize an orifice effect in order to prevent gas from being directed toward the inside of a nozzle aperture.

FIG. 4 is a cross-sectional view of a wiping apparatus disclosed in Patent Literature 5 in the process of wiping nozzle plate 11 of ink-jet head 10. As shown in FIG. 4, a wiping apparatus disclosed in Patent Literature 5 has gas suction aperture 150 and gas guide section 120 having projections 121.

As shown in FIG. 4, between projections 121 of a wiping apparatus disclosed in Patent Literature 5 and nozzle plate 11, orifice sections 123 are formed where the distance between gas guide section 120 and nozzle plate 11 is smaller. When gas is sucked in from gas suction aperture 150 in a state in which orifice sections 123 are formed, the flow rate of the gas increases in orifice sections 123 due to an orifice effect, and foreign substance and the like adhering to the surface of nozzle plate 11 is blown away. Thus, with a wiping apparatus utilizing an orifice effect, gas is not injected at an angle with respect to nozzle plate 11, so that gas is not directed toward the inside of a nozzle aperture.

CITATION LIST

Patent Literature

PTL 1: Japanese Patent Application Laid-Open No. 2005-169730

PTL 2: Japanese Patent Application Laid-Open No. 2000-62197

PTL 3: Japanese Patent Application Laid-Open No. HEI2-108549

PTL 4: U.S. Pat. No. 4,970,535 Specification

PTL 5: Japanese Patent Application Laid-Open No. 2004-90361

PTL 6: Japanese Patent Application Laid-Open No. SHO63-242643

PTL 7: U.S. Pat. No. 4,908,636 Specification

SUMMARY OF INVENTION

Technical Problem

However, when gas is injected parallel to nozzle plate 11 from gas injection aperture 130, as shown in FIG. 3B, an area in which the gas flow rate is high, and nozzle plate 11, are inevitably separated. Consequently, there is a risk of not being able to provide a sufficient gas flow rate in the vicinity of nozzle plate 11, and of not being able to blow away foreign substance. Therefore, with a wiping apparatus such as shown in FIG. 3B, there is a requirement for the flow rate of gas injected from gas injection aperture 130 to be speeded up in order to provide a gas flow rate in the vicinity of nozzle plate 11.

However, if the gas flow rate is increased in a wiping apparatus such as shown in FIG. 3B, a gas flow having a component at an angle to the nozzle plate is created. Consequently, with a wiping apparatus such as shown in FIG. 3B, the problem of gas being directed toward the inside of nozzle aperture 13, and ink 15 inside nozzle aperture 13 drying, cannot be solved.

With a wiping apparatus such as shown in FIG. 3B, one possibility is to secure a gas flow rate in the vicinity of nozzle plate 11 by bringing the wiping apparatus and nozzle plate 11 closer to each other. However, if the wiping apparatus and nozzle plate 11 are brought too close to each other, the wiping apparatus and nozzle plate 11 will come into contact, and the water-repellent coating on the surface of the nozzle plate will be damaged.

Also, with a wiping apparatus that utilizes an orifice effect such as shown in FIG. 4, although gas is not directed toward the inside of nozzle aperture 13, there is a requirement of setting the distance between the wiping apparatus and nozzle plate 11 accurately in order to achieve a high-speed gas flow in orifice sections 123. Consequently, if the nozzle plate has a step or gap, such as at the edge of the ink-jet head or the nozzle plate joint, the gas flow rate will decrease and foreign substance cannot be blown away.

Furthermore, with a wiping apparatus that utilizes an orifice effect such as shown in FIG. 4, in order to produce an effective orifice effect, there is a requirement for a gas flow channel formed between gas guide section 120 and nozzle plate 11 to be sealed off from the outside. Consequently, with a wiping apparatus that utilizes an orifice effect, there is a requirement for wall 125 of gas guide section 120 to be brought into contact with nozzle plate 11, as shown in FIG. 5. When wall 125 of gas guide section 120 is in contact with nozzle plate 11 in this way, the water-repellent coating on the surface of nozzle plate 11 suffers wear.

It is therefore an object of the present invention to provide a wiping apparatus capable of forming a gas flow that is parallel to a nozzle plate and is stable, without coming into contact with the nozzle plate.

Solution to Problem

The present inventors have found out that a gas flow that is parallel to a nozzle plate and is stable can be formed by guiding gas along a curved surface by means of a Coanda effect, applied further investigation, and completed the present invention. That is to say, a first aspect of the present invention relates to the wiping apparatuses shown below.

[1] A wiping apparatus having a gas injection aperture that injects gas, and a guide section that has a convexly curved surface and has an apex and over which the gas injected from the gas injection aperture is blown, and, in this wiping apparatus, a foreign substance adhering to a nozzle plate of an ink-jet head placed above the guide section is blown away by the gas guided along the curved surface of the guide section.

[2] The wiping apparatus described in [1], in which the curvature radius of the curved surface is 5 to 200 mm.

[3] The wiping apparatus described in [1] or [2], in which the angle of incidence of the gas injected from the gas injection aperture with respect to the curved surface is 30 to 90°.

[4] The wiping apparatus described in one of [1] through [3], in which the curved surface is a convex cylindrical surface having a top line, and the gas injection aperture is a slit having a long axis parallel to the top line of the curved surface.

[5] The wiping apparatus described in one of [1] through [3], further having a gas suction aperture that sucks in the foreign substance that is blown away, in which the gas suction aperture and the gas injection aperture are facing each other across the guide section.

[6] The wiping apparatus described in [5], in which the curved surface is a convex cylindrical surface having a top line, the gas injection aperture is a slit having a long axis parallel to the top line of the curved surface, and the gas suction aperture is a slit having a long axis parallel to the top line of the curved surface.

[7] The wiping apparatus described in [6], further having a housing that houses the guide section, in which the housing has an injection aperture plate and a suction aperture plate that are separated from each other and form the roof of the housing, and an opening section that is formed between the injection aperture plate and suction aperture plate and where the top line of the curved surface is exposed, the gas injection aperture is a gap between the curved surface and the injection aperture plate, and the gas suction aperture is a gap between the curved surface and the suction aperture plate.

[8] The wiping apparatus described in [7], in which, the injection aperture plate and the suction aperture plate each have a surface facing the nozzle plate, a portion of the surface in the vicinity of the opening section is parallel to the nozzle plate.

[9] The wiping apparatus described in one of [1] through [8], having a diffuser plate that distributes the gas inside the gas injection aperture.

A second aspect of the present invention relates to the ink-jet apparatus shown below.

[10] An ink-jet apparatus equipped with a wiping apparatus described in one of [1] through [9].

A third aspect of the present invention relates to the nozzle plate wiping methods shown below.

[11] A nozzle plate wiping method having a step of providing a wiping apparatus described in one of [1] through [9], a step of placing an ink-jet head above the wiping apparatus so that the curved surface and the nozzle plate are facing each other, and a step of injecting gas from the gas injection aperture, moving the wiping apparatus relative to the nozzle plate while maintaining a fixed distance between the curved surface and the nozzle plate, and blowing away foreign substance adhering to the nozzle plate by means of gas guided along the curved surface.

[12] The wiping method described in [11], in which the flow rate of the gas injected from the gas injection aperture is 15 m/s or above.

[13] The wiping method described in [11] or [12], in which the distance between the curved surface and the nozzle plate is 0.2 to 1.5 mm.

Advantageous Effects of Invention

A wiping apparatus of the present invention can form a gas flow that is parallel to a nozzle plate and is stable without coming into contact with the nozzle plate. Consequently, the present invention can prevent ink from drying inside a nozzle aperture, and can remove foreign substance adhering to the nozzle plate without damaging a water-repellent coating on the surface of the nozzle plate.

DESCRIPTION OF EMBODIMENTS

Figure 1A:
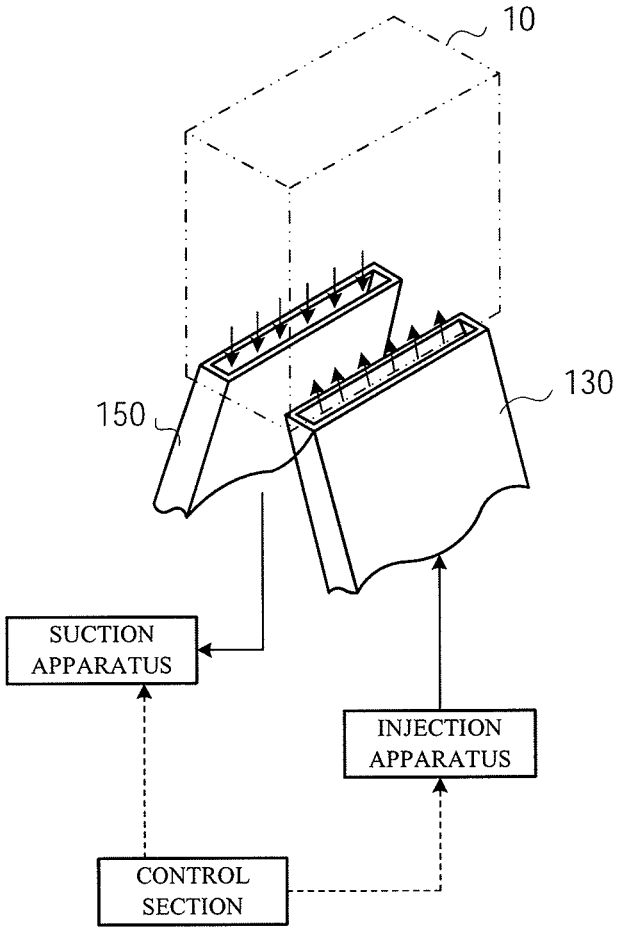
FIG. 1 comprises schematic diagrams of a conventional wiping apparatus.
Figure 1B:
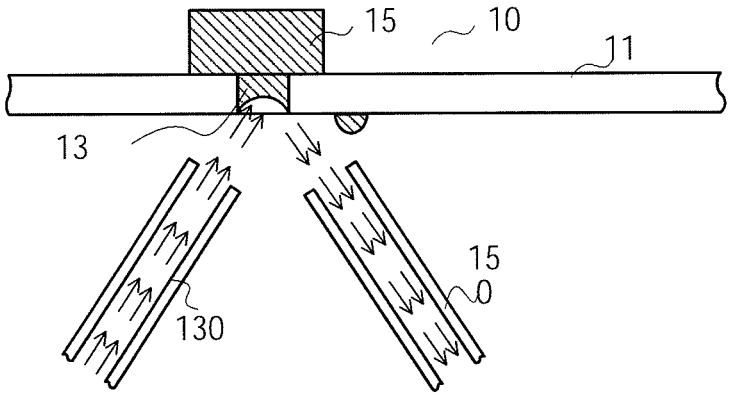
Figure 2:
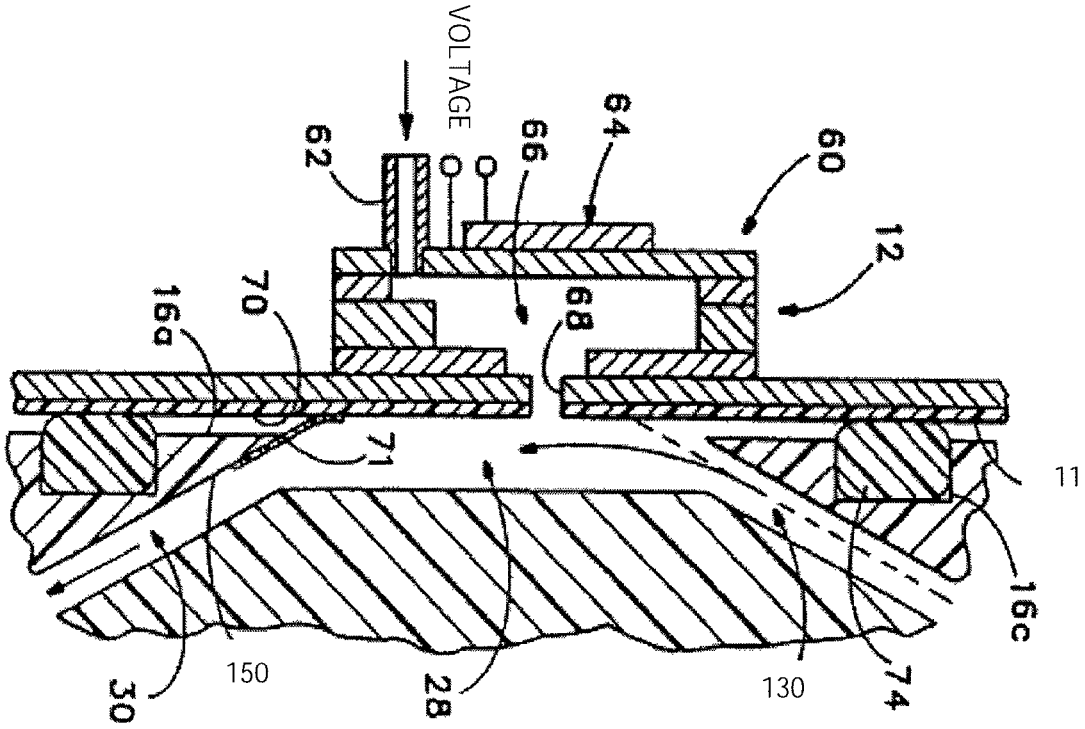
FIG. 2 is a cross-sectional view of a conventional wiping apparatus.
Figure 3A:
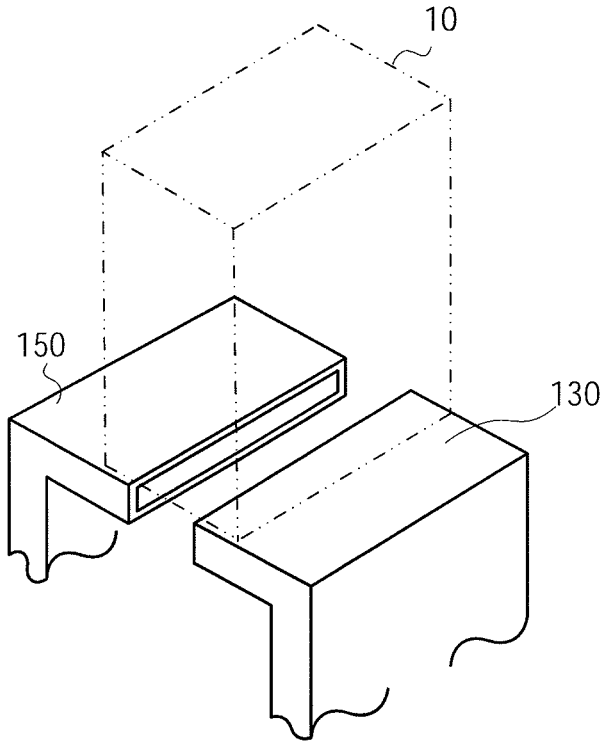
FIG. 3 comprises schematic diagrams of a conventional wiping apparatus.
Figure 3B:
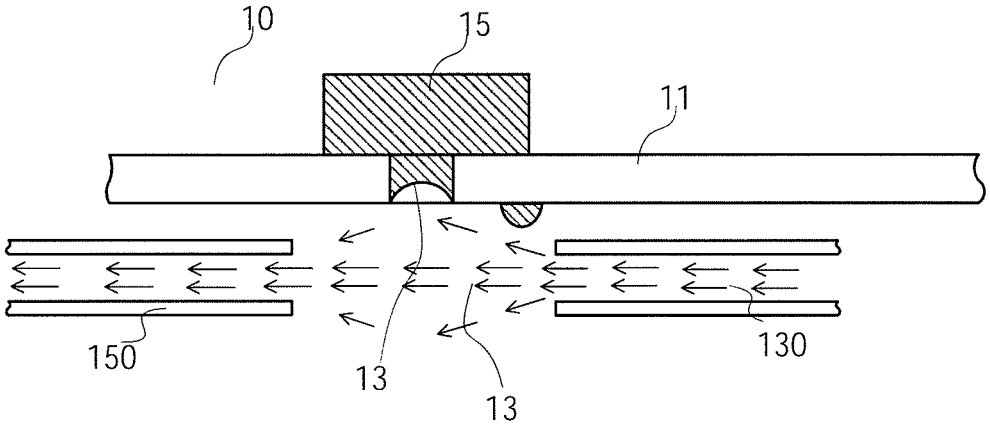
Figure 4:
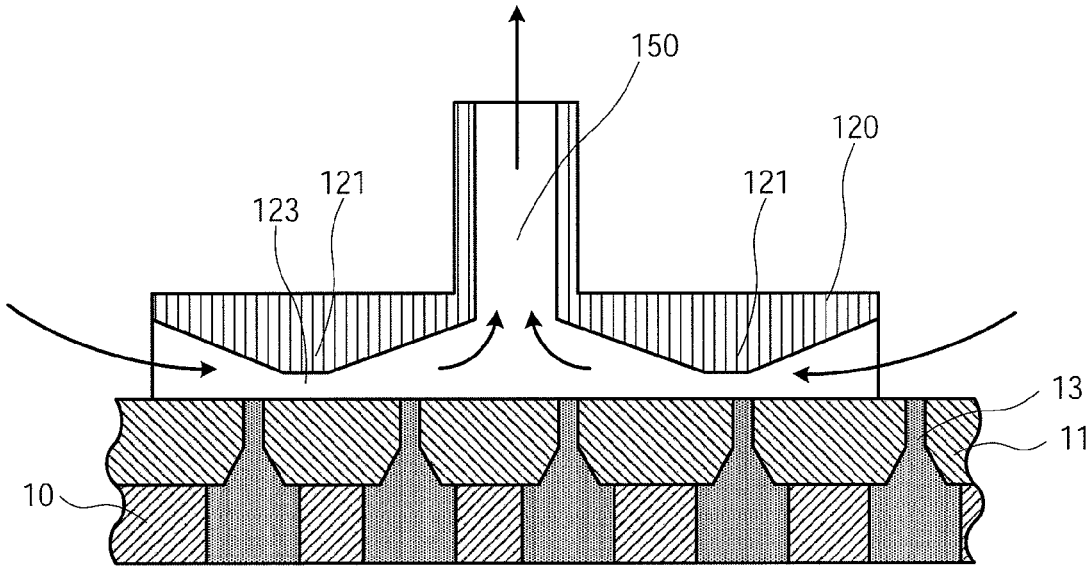
FIG. 4 is a cross-sectional view of a conventional wiping apparatus.
Figure 5:
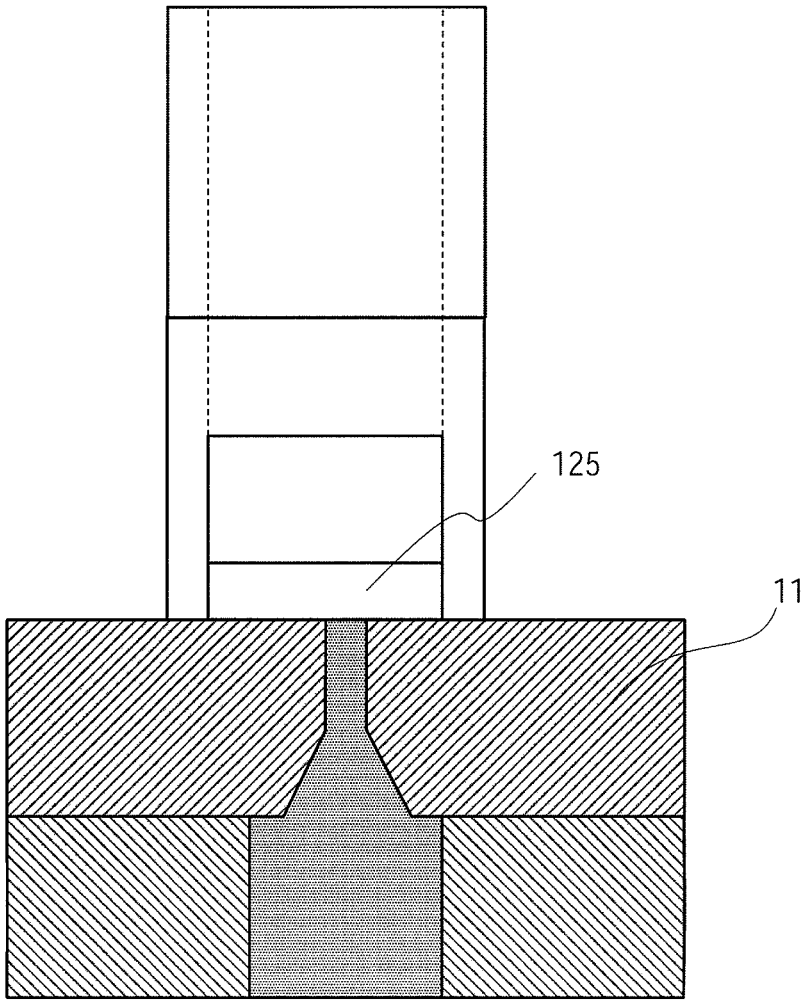
FIG. 5 is a side view of a conventional wiping apparatus.

1. Wiping Apparatus of the Present Invention

A wiping apparatus of the present invention has, at least, a gas injection aperture that injects gas, and a guide section having a curved surface over which gas injected from the gas injection aperture is blown.

A wiping apparatus of the present invention is characterized by blowing away foreign substance adhering to a nozzle plate of an ink-jet head by means of gas guided by a curved surface of a guide section by means of a Coanda effect, without coming into contact with the nozzle plate. Components of the present invention are described below.

A gas injection aperture is an aperture for injecting gas for blowing away foreign substance adhering to a nozzle plate of an ink-jet head. Gas injected from the gas injection aperture is air, nitrogen, a solvent vapor of ink accommodated in an ink-jet head, or the like. By using an ink solvent vapor as gas to be injected, it is possible to prevent ink inside a nozzle from drying when wiping an ink-jet head with a wiping apparatus of the present invention.

It is preferable for the flow rate of gas injected from the gas injection aperture to be 15 m/s or above. This is because foreign substance adhering to the nozzle plate cannot be blown away if the flow rate of the injected gas is less than 15 m/s.

Although there are no particular limitations on the shape of the gas injection aperture, a slit having a long axis is preferable (see FIG. 6). Also, a diffuser plate may be provided inside the gas injection aperture (see Embodiment 5). By providing a diffuser plate inside the gas injection aperture, it is possible to make the flow rate of gas injected from the gas injection aperture uniform.

A guide section is a member for guiding gas injected from the gas injection aperture. In the present invention, the guide section is characterized by having a convexly curved surface and has an apex. Of the curved surface, at least the vicinity of the apex is exposed to the outside. Although the curved surface needs only to have an apex, it may also be a cylindrical surface having a top line (see FIG. 6A). Here, "top line" refers to a generatrix of the cylindrical surface passing through the apex. If the curved surface is a cylindrical surface having a top line, the curved surface may be axisymmetrical about the top line, or may be asymmetrical about the top line. When an ink-jet head is wiped by means of a wiping apparatus of the present invention, the apex of the curved surface is facing the nozzle plate of the ink-jet head.

If the curved surface is a cylindrical surface having a top line, it is preferable for the top line of the curved surface to be parallel to the long axis of the slit-shaped gas injection aperture. By providing the wiping apparatus with a guide section having a cylindrical surface that has a top line, and a gas injection aperture that is a slit having a long axis parallel to the top line of the cylindrical surface, it is possible to wipe over a greater width, and thus to wipe a larger area at one time.

A characteristic of the present invention is that the guide section guides gas injected from a gas injection aperture along a curved surface by means of a Coanda effect. Here, "Coanda effect" refers to a phenomenon whereby, when a body is placed in a fluid having viscosity, the direction of the fluid changes along that body. That is to say, a characteristic of the present invention is that the shape of the curved surface of the guide section is designed so as to produce a "Coanda effect."

The structure of a curved surface of a guide section for producing a "Coanda effect" differs according to the type and flow rate of gas injected from the gas injection aperture. For example, when air with a flow rate of 15 m/s is injected from the gas injection aperture, gas can be guided by means of a Coanda effect if the curvature radius of the curved surface in the direction of flow of the gas is 5 to 200 mm, and the length of the chord of the curved surface guiding the gas is 5 to 60 mm.

Although a Coanda effect will also occur if the curvature radius of the curved surface in the direction of flow of the gas exceeds 200 mm, the wiping apparatus will be excessively large in this case, and therefore, it is preferable that a curvature radius does not exceed 200 mm.

Also, in order to produce a Coanda effect, it is preferable for the angle of incidence of gas with respect to the curved surface to be 30 to 90°. Here "angle of incidence of gas" refers to the angle between the normal of the curved surface at a point on the curved surface nearest the gas injection aperture, and the direction in which gas is injected (see FIG. 6B). If the angle of incidence of gas is less than 30°, component of the gas flow along the curved surface will become weaker, and gas will not flow efficiently along the curved surface.

A wiping apparatus of the present invention may also have a gas suction aperture for sucking in foreign substance blown away by injected gas.

A gas suction aperture is placed downstream in the gas flow. Specifically, a gas suction aperture and the gas injection aperture are facing each other across the guide section (see FIG. 9). By providing the wiping apparatus with a gas suction aperture, it is possible to collect foreign substance that has been blown away by the gas suction aperture and therefore prevent foreign substance from being scattered about.

Although there are no particular limitations on the shape of the gas suction aperture, when the gas injection aperture is a slit, as described above, it is preferable for the gas suction aperture also to be a slit, having a long axis parallel to the top line of the cylindrical surface of the guide section.

In order to wipe a nozzle plate using a wiping apparatus of this kind, the curved surface of the guide section should be brought close to the nozzle plate while blowing gas onto the curved surface of the guide section from the gas injection aperture. By this means, the gas flow along the curved surface comes into contact with the nozzle plate, and can blow away foreign substance adhering to the nozzle plate. Then, the entire nozzle plate can be wiped by moving the wiping apparatus relative to the nozzle plate while maintaining a fixed distance between the curved surface of the guide section and the nozzle plate.

Since a gas flow guided along a convexly curved surface becomes similarly convex, a gas flow that comes into contact with the nozzle plate becomes parallel to the nozzle plate. Consequently, gas is not directed toward the inside of a nozzle aperture, and ink inside a nozzle aperture does not dry, as happens with a conventional wiping apparatus.

The flow volume and flow rate of gas are controlled by the flow volume and flow rate of gas injected from the gas injection aperture. Consequently, with the present invention, it does not happen that the gas flow volume and flow rate become unstable due to the shape of the nozzle plate or the like, as is the case with a conventional wiping apparatus that utilizes an orifice effect. Therefore, the gas flow rate does not decrease and a stable gas flow can be maintained even if the nozzle plate has a step or gap.

2. Ink-Jet Apparatus of the Present Invention

A characteristic of an ink-jet apparatus of the present invention is that it is provided with a wiping apparatus of the present invention and an ink-jet head. An ink-jet apparatus may also have two or more ink-jet heads. In addition to a wiping apparatus and ink-jet head, an ink-jet apparatus also includes a stage for moving material to which ink is to be applied, a control mechanism that controls movement of the stage, and so forth.

Now, embodiments of the present invention will be described with reference to the accompanying drawings. The scope of the present invention, however, is not limited to the following embodiments.

Embodiment 1

Figure 6A:
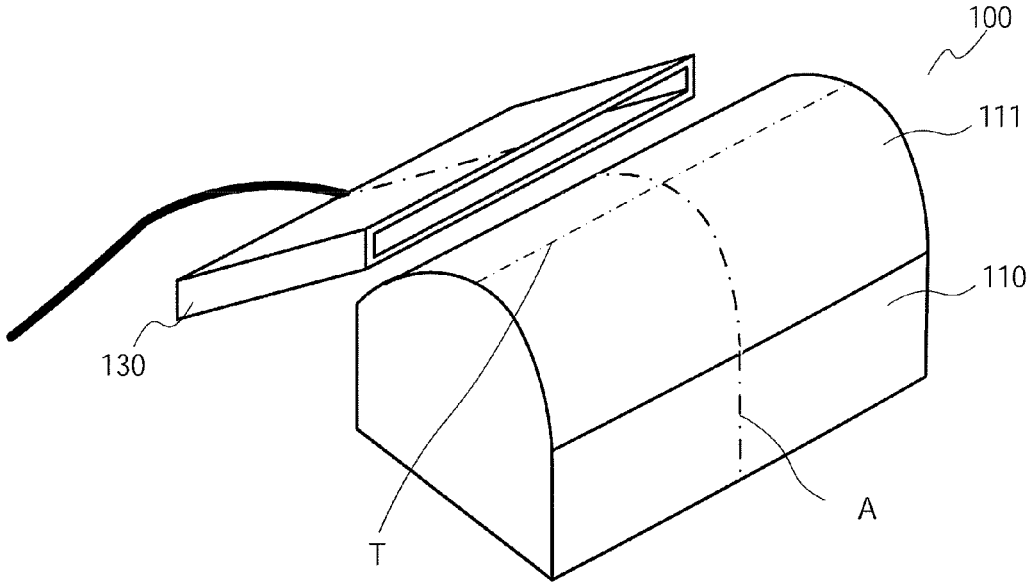
FIG. 6 comprises drawings showing a wiping apparatus of Embodiment 1.
Figure 6B:
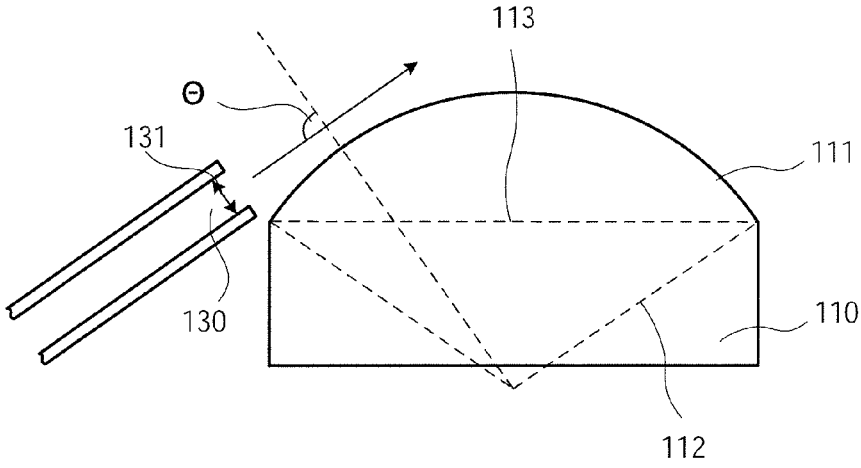

FIG. 6A is a perspective view of wiping apparatus 100 of Embodiment 1 of the present invention. As shown in FIG. 6A, wiping apparatus 100 has guide section 110 having curved surface 111 consisting of a cylindrical surface having top line T, and slit-shaped gas injection aperture 130 having a long axis parallel to top line T. Also, as shown in FIG. 6A, curved surface 111 of guide section 110 is exposed to the outside. FIG. 6B is a cross-sectional view taken along with dash-dot line A of wiping apparatus 100 shown in FIG. 6A. Dash-dot line A is parallel to the direction of flow of gas injected from gas injection aperture 130.

Curvature radius 112 of curved surface 111 shown in FIG. 6B is 5 to 200 mm, and the length of chord 113 is 5 to 60 mm. Curvature radius 112 of curved surface 111 may be fixed, or may be changed. For example, when curved surface 111 is divided into two areas by the top line, curvature radius 112 of the surface area on the gas injection aperture 130 side may be equal to or less than curvature radius 112 of the other area.

Width 131 of gas injection aperture 130 is 0.2 to 1.5 mm. Also, gas injection aperture 130 is adjusted so that angle of incidence θ of injected gas with respect to curved surface 111 is 30° to 90°.

A nozzle plate wiping method using a wiping apparatus according to Embodiment 1 will now be described with reference to FIG. 7A through FIG. 8B.

As shown in FIG. 7A through FIG. 8B, a wiping method of this embodiment has: (1) a first step (FIG. 7A) of providing wiping apparatus 100 of Embodiment 1; (2) a second step (FIG. 7B) of placing ink-jet head 10 above wiping apparatus 100 so that curved surface 111 and nozzle plate 11 are facing each other; and (3) a third step (FIG. 8A and FIG. 8B) of injecting gas from gas injection aperture 130, and moving wiping apparatus 100 relative to nozzle plate 11 while maintaining fixed distance D1 between curved surface 111 and nozzle plate 11.

Figure 7A:
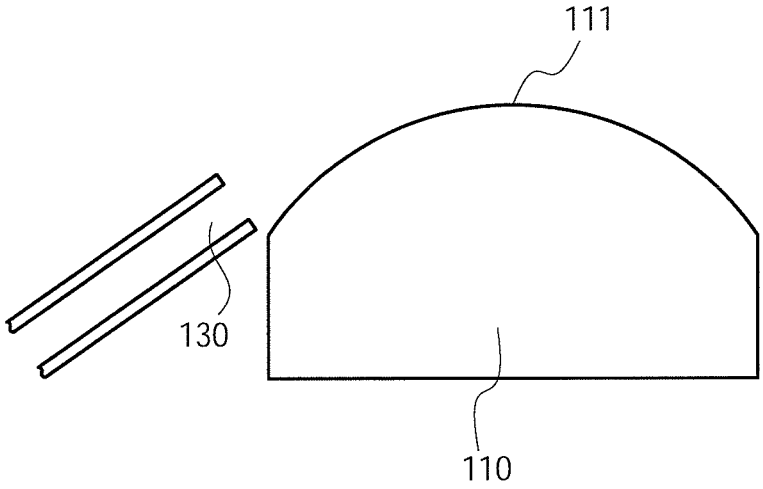
FIG. 7 comprises drawings showing the flow of a wiping method using a wiping apparatus of Embodiment 1.

(1) FIG. 7A shows the first step. As shown in FIG. 7A, in the first step, wiping apparatus 100 of Embodiment 1 shown in FIG. 6A and FIG. 6B is provided.

Figure 7B:
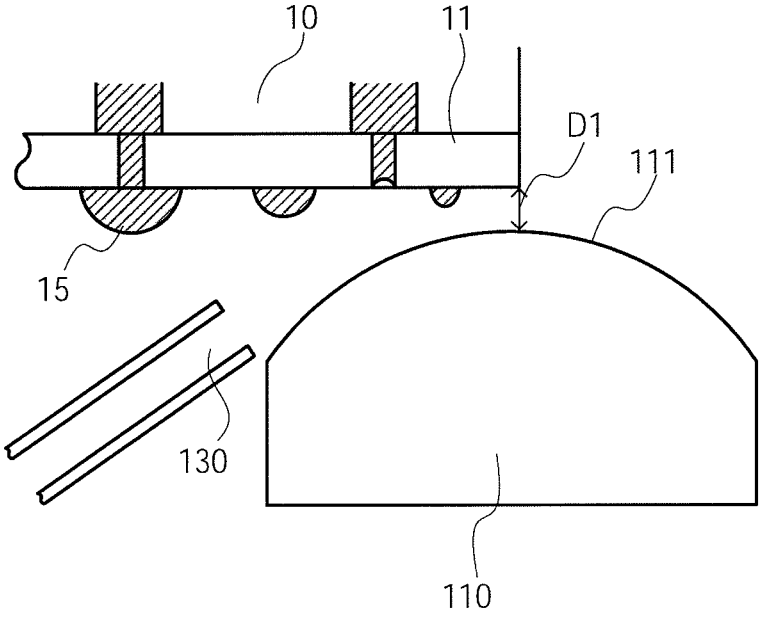

(2) FIG. 7B shows the second step. As shown in FIG. 7B, in the second step, ink-jet head 10 is placed above wiping apparatus 100 so that curved surface 111 of wiping apparatus 100 and nozzle plate 11 of ink-jet head 10 are facing each other. Curved surface 111 and nozzle plate 11 are separated from each other, and distance D1 is formed between the two.

FIG. 7B shows an example in which wiping apparatus 100 is placed below nozzle plate 11 in the direction of gravitational force, but wiping apparatus 100 may also be placed above nozzle plate 11 in the direction of gravitational force. This is because the above-described Coanda effect is stronger than the influence of gravity. Also, as shown in FIG. 7B, ink drops 15 adhere to nozzle plate 11 as foreign substance.

Figure 8A:
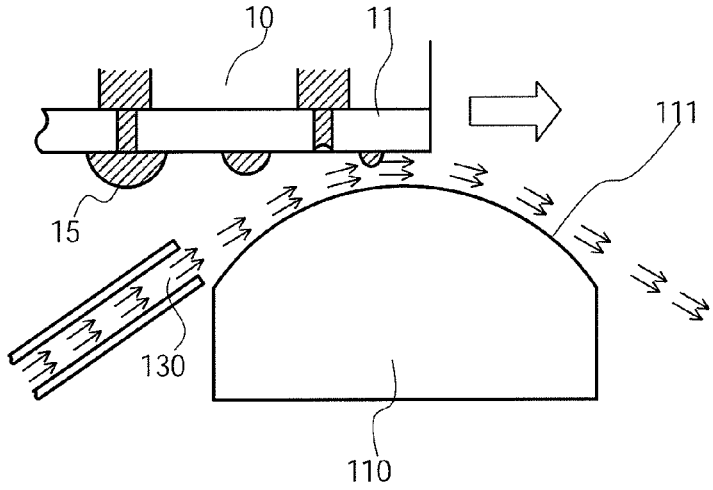
FIG. 8 comprises drawings showing the flow of a wiping method using a wiping apparatus of Embodiment 1.
Figure 8B:
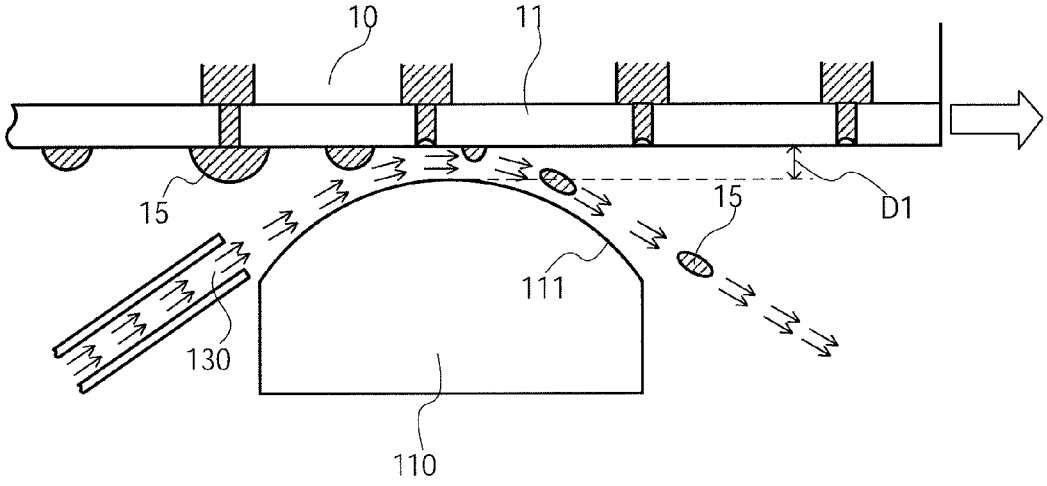

(3) FIG. 8A and FIG. 8B show the third step. As shown in FIG. 8A and FIG. 8B, in the third step, gas injected from gas injection aperture 130 is blown against curved surface 111, and wiping apparatus 100 is moved relative to nozzle plate 11 by a movement mechanism (not shown) while maintaining fixed distance D1 between curved surface 111 and nozzle plate 11.

Gas injected from gas injection aperture 130 is blown onto curved surface 111 from one edge E1 of curved surface 111 toward the apex of curved surface 111.

To move wiping apparatus 100 relative to nozzle plate 11, ink-jet head 10 (nozzle plate 11) may be moved, wiping apparatus 100 may be moved, or wiping apparatus 100 and ink-jet head 10 may both be moved.

Gas injected from gas injection aperture 130 as shown in FIG. 8A and FIG. 8B is guided along curved surface 111 by means of a Coanda effect. Distance D1 between curved surface 111 and nozzle plate 11 is not particularly limited, but is set so that the gas flow along curved surface 111 comes into contact with nozzle plate 11. Specifically, distance D1 is approximately 0.2 to 1.5 mm. If distance D1 is less than 0.2 mm, there is a risk of the curved surface and the nozzle plate coming into contact during relative movement of the wiping apparatus. On the other hand, if distance D1 exceeds 1.5 mm, the gas flow and nozzle plate 11 are too far from each other to blow ink drops 15 away.

By moving wiping apparatus 100 relative to nozzle plate 11 while injecting gas from gas injection aperture 130 in this way, ink drops 15 adhering to nozzle plate 11 are blown away by gas guided along curved surface 111. Ink drops 15 that are blown away are transported directly by the gas flow, and are ejected from the surface of nozzle plate 11.

Since a gas flow along convexly curved surface 11 becomes convex in shape in the same way as curved surface 111, a gas flow that comes into contact with nozzle plate 11 becomes parallel to nozzle plate 11. Consequently, gas is not directed toward the inside of a nozzle aperture, and a nozzle aperture does not dry out, as happens with a conventional wiping apparatus.

The flow rate of a gas flow that comes into contact with nozzle plate 11 is controlled by the flow rate of gas injected from gas injection aperture 130. Consequently, the flow rate of a gas flow that comes into contact with nozzle plate 11 in this embodiment is not affected by the shape of the nozzle plate, as is the case with a conventional wiping apparatus that utilizes an orifice effect. Therefore, the gas flow rate does not decrease at an edge of the nozzle plate, a nozzle plate joint, or the like. Thus, the nozzle plate can be wiped without any problem even if an ink-jet apparatus has a large head consisting of a plurality of ink-jet heads.

Embodiment 2

In Embodiment 2, a wiping apparatus with a gas suction aperture is described.

Figure 9:
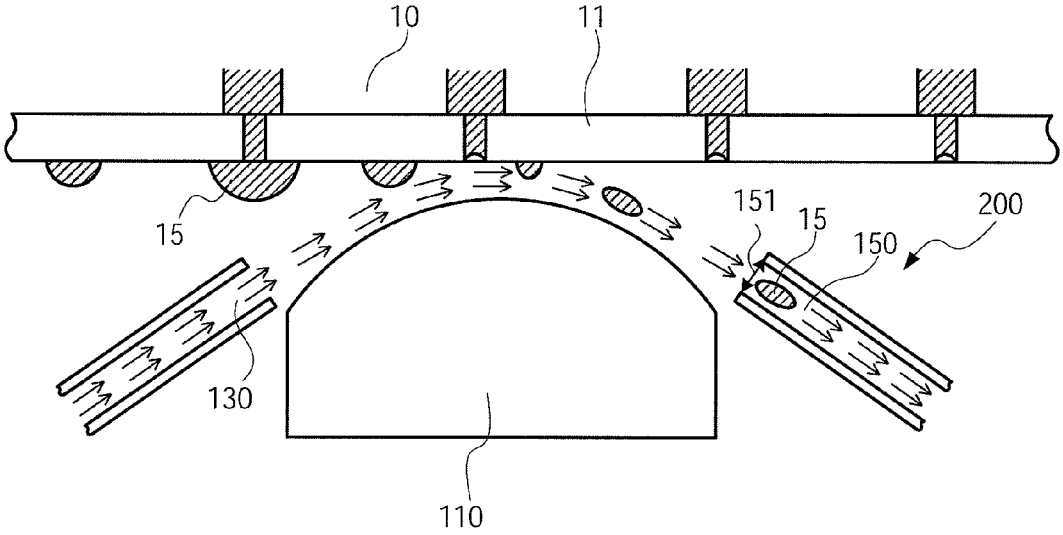
FIG. 9 is a cross-sectional view of a wiping apparatus of Embodiment 2.

FIG. 9 is a cross-sectional view of wiping apparatus 200 of Embodiment 2 in the process of wiping nozzle plate 11. Components identical to those of wiping apparatus 100 of Embodiment 1 are assigned the same reference codes, and descriptions thereof are omitted here. As shown in FIG. 9, wiping apparatus 200 of Embodiment 2 has gas suction aperture 150.

Gas suction aperture 150 is placed downstream in the gas flow so that gas guided along curved surface 111 by means of a Coanda effect flows into gas suction aperture 150. Specifically, gas suction aperture 150 and gas injection aperture 130 are facing each other across guide section 110. Gas suction aperture 150 is a slit having a long axis parallel to the top line of curved surface 111 in the same way as gas injection aperture 130. By providing wiping apparatus 200 with gas suction aperture 150, it is possible to collect ink drops 15 that have been blown away by gas suction aperture 150 and therefore to prevent ink drops 15 from being scattered about.

It is preferable for width 151 of gas suction aperture 150 to be larger than width 131 of gas injection aperture 130 (FIG. 6B). By making width 151 of gas suction aperture 150 larger than width 131 of gas injection aperture 130 (FIG. 6B), it is possible to collect ink drops 15 that have been blown away more dependably. Specifically, it is preferable for width 151 of gas suction aperture 150 to be 0.5 to 2.5 mm.

Thus, according to Embodiment 2, in addition to provision of the effects of Embodiment 1, ink drops 15 that have been blown away by means of injected gas can be collected by means of gas suction aperture 150, and ink drops 15 that have been blown away can be prevented from being scattered about.

Embodiment 3

In Embodiment 3, a wiping apparatus is described in which a gas injection aperture, guide section, and gas suction aperture are integrated.

Figure 10:
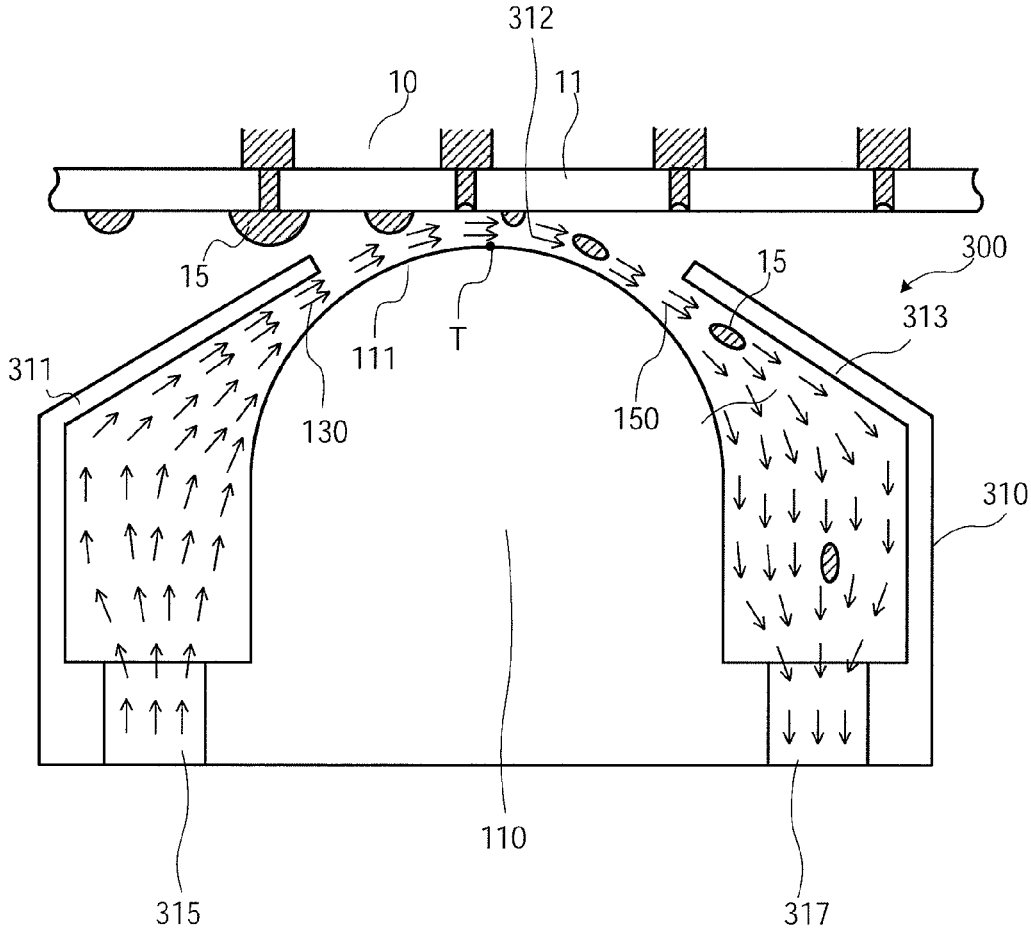
FIG. 10 is a cross-sectional view of a wiping apparatus of Embodiment 3.

FIG. 10 is a cross-sectional view of wiping apparatus 300 of Embodiment 3 in the process of wiping nozzle plate 11. Components identical to those of wiping apparatus 100 of Embodiment 1 and Embodiment 2 are assigned the same reference codes, and descriptions thereof are omitted here.

As shown in FIG. 10, wiping apparatus 300 of Embodiment 3 has housing 310 that houses guide section 110. Housing 310 has injection aperture plate 311 and suction aperture plate 313 that form the roof of housing 310. Injection aperture plate 311 and suction aperture plate 313 cover part of curved surface 111 but do not come into contact with curved surface 111. Injection aperture plate 311 and suction aperture plate 313 are separated from each other, and opening section 312 is formed between the two. It is preferable for opening section 312 to have a long axis parallel to top line T of curved surface 111 (see FIG. 11A).

Top line T of curved surface 111 is exposed to the outside through opening section 312. Guide section 110 and housing 310 may be connected by fastening, welding, soldering, or the like.

In this embodiment, gas injection aperture 130 and gas suction aperture 150 are integrated with curved surface 111. Specifically, gas injection aperture 130 is formed by a gap between injection aperture plate 311 and curved surface 111, and gas suction aperture 150 is formed by a gap between suction aperture plate 313 and curved surface 111.

Gas injection aperture 130 is connected with gas supply port 315, and gas suction aperture 150 is connected to gas outlet 317. There may be one gas supply port 315 and one gas outlet 317, or two or more of each. In this embodiment, gas supply port 315 and gas outlet 317 are provided in the bottom surface of housing 310, but gas supply port 315 and gas outlet 317 may also be provided in a side of housing 310.

Integrating the gas injection aperture, guide section, and gas suction aperture in this way enables a wiping apparatus to be made more compact, in addition to achieving the effects of Embodiment 2. Also, by integrating the gas injection aperture, guide section, and gas suction aperture, it is possible to eliminate the task of adjusting the relative positions of the gas injection aperture, gas suction aperture, and guide section.

Also, by integrating the gas suction aperture with the curved surface, it is possible to suck in ink drops more dependably. This is because ink drops are normally sucked into the gas suction aperture while adhering onto the curved surface.

Embodiment 4

In Embodiment 4, a wiping apparatus is described in which a portion of injection aperture plate and suction aperture plate is parallel to the nozzle plate.

Figure 11A:
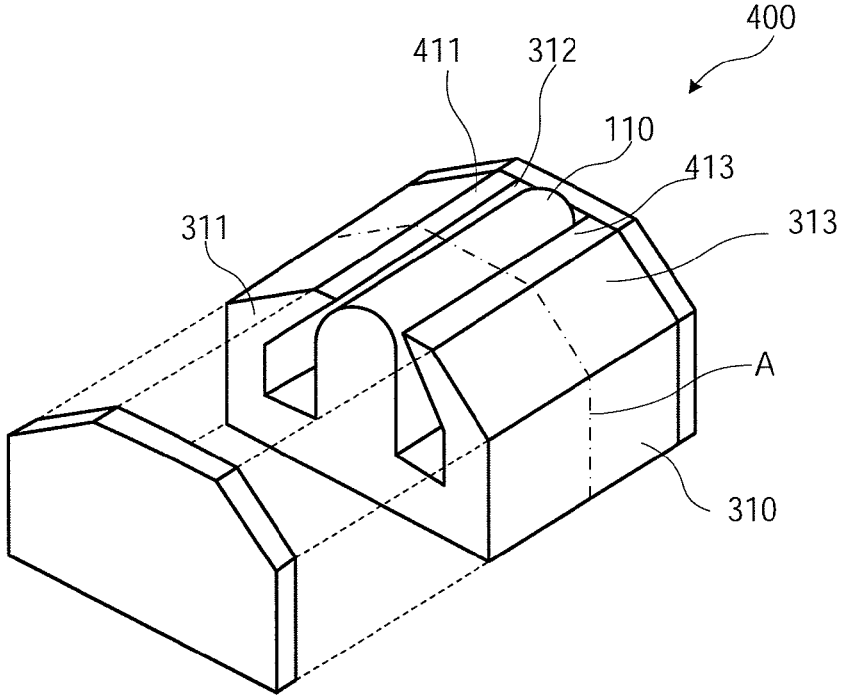
FIG. 11 comprises drawings showing a wiping apparatus of Embodiment 4.
Figure 11B:
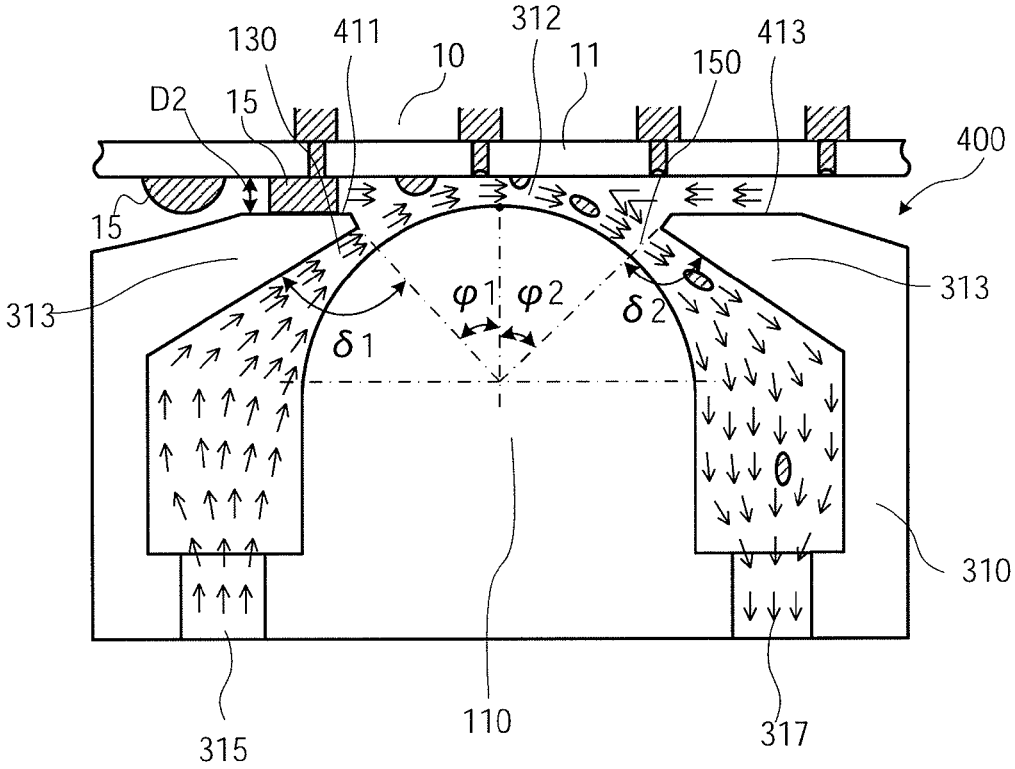

FIG. 11A is an exploded perspective view of wiping apparatus 400 of this embodiment, and FIG. 11B is a cross-sectional view taken along with dash-dot line A of wiping apparatus 400 shown in FIG. 11A in the process of wiping nozzle plate 11. Components identical to those of the wiping apparatus of Embodiment 3 are assigned the same reference codes, and descriptions thereof are omitted here.

As shown in FIG. 11B and FIG. 11A, injection aperture plate 311 has a surface facing nozzle plate 11. A portion (hereinafter also referred to as "parallel portion") 411 near opening section 312 of the surface of injection aperture plate 311 is approximately parallel to nozzle plate 11. Similarly, suction aperture plate 313 has a surface facing nozzle plate 11. A portion (hereinafter also referred to as "parallel portion") 413 near opening section 312 of the surface of suction aperture plate 313 is approximately parallel to nozzle plate 11.

Providing parallel portions on injection aperture plate 311 and suction aperture plate 313 in this way enables gas flows to be formed between nozzle plate 11 and the parallel portions as shown in FIG. 11B. Distance D2 between nozzle plate 11 and the parallel portions is normally 0.2 to 1.5 mm.

Specifically, in this embodiment, a gas flow toward opening section 312 is created between parallel portion 411 and nozzle plate 11, and a gas flow toward opening section 312 is created between parallel portion 413 and nozzle plate 11. In this way, ink drops 15 adhering to nozzle plate 11 can be conveyed to opening section 312 by means of the gas flows. Ink drops 15 conveyed as far as opening section 312 are blown away by gas guided along curved surface 111, and sucked into gas suction aperture 150. By providing wiping apparatus 400 of this embodiment with a function of collecting ink drops 15 in this way, it is possible to blow away ink drops 15 more effectively.

If the parallel portions are lyophilic, they can also have a liquid wiping function. That is to say, if the parallel portions are lyophilic, when ink drops 15 adhering to nozzle plate 11 come into contact with a parallel portion, ink drops 15 move from nozzle plate 11 that has undergone liquid-repellent processing, to a lyophilic parallel portion, and can be removed from nozzle plate 11.

Ink drops 15 that have moved to a lyophilic parallel portion flow over the outside of housing 310 and fall, or are conveyed to opening section 312 by a gas flow between nozzle plate 11 and a parallel portion. Ink drops 15 conveyed to opening section 312 are blow away by gas guided along curved surface 111, and are sucked into gas suction aperture 150.

Thus, according to this embodiment, ink drops can be collected at the opening section, thereby offering the advantage of removing ink drops adhering to the nozzle plate with a small gas flow volume, in addition to the effects of Embodiment 3.

Embodiment 5

In Embodiment 5, a wiping apparatus is described in which a diffuser plate is provided inside a gas injection aperture and a gas suction aperture.

Figure 12:
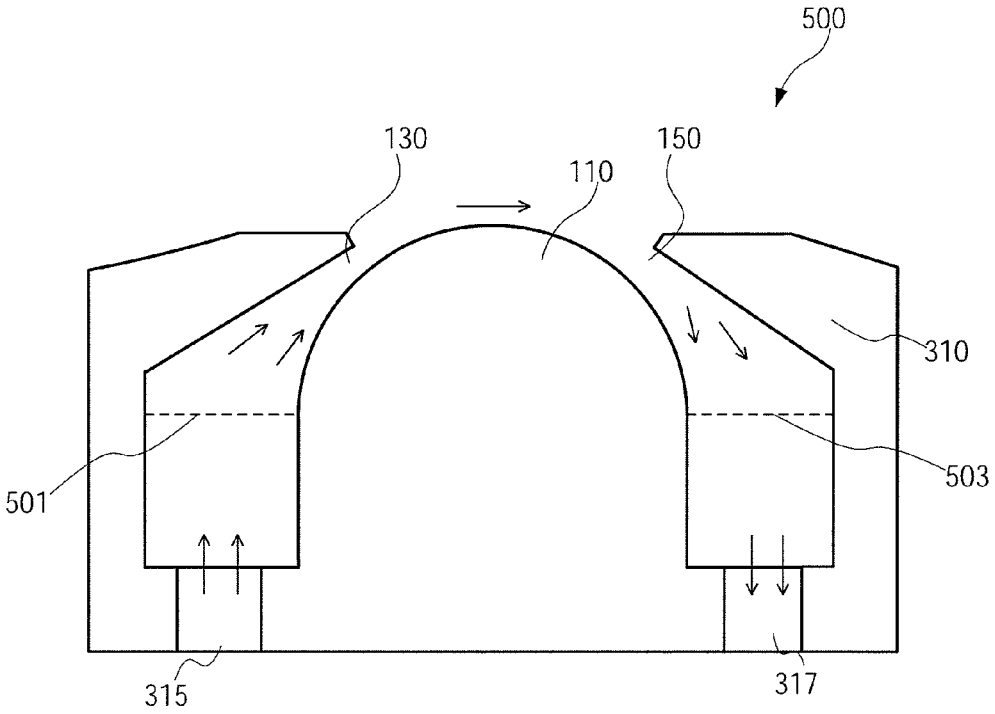
FIG. 12 is a cross-sectional view of a wiping apparatus of Embodiment 5.

FIG. 12 is a cross-sectional view of wiping apparatus 500 of Embodiment 5. Components identical to those of wiping apparatus 400 of Embodiment 4 are assigned the same reference codes, and descriptions thereof are omitted here. As shown in FIG. 12, wiping apparatus 500 of this embodiment has diffuser plate 501 inside gas injection aperture 130, and has diffuser plate 503 inside gas suction aperture 150. Diffuser plates 501 and 503 have numerous holes 3 to 10 mm in diameter. The holes in diffuser plates 501 and 503 may be uniformly distributed over the entirety of diffuser plates 501 and 503, or may be distributed non-uniformly. For example, the placement pitch of holes in the center of a diffuser plate (in the vicinity of gas supply port 315) may be made smaller than the placement pitch of holes at the edge of a diffuser plate (in the vicinity of housing 310).

Figure 13:
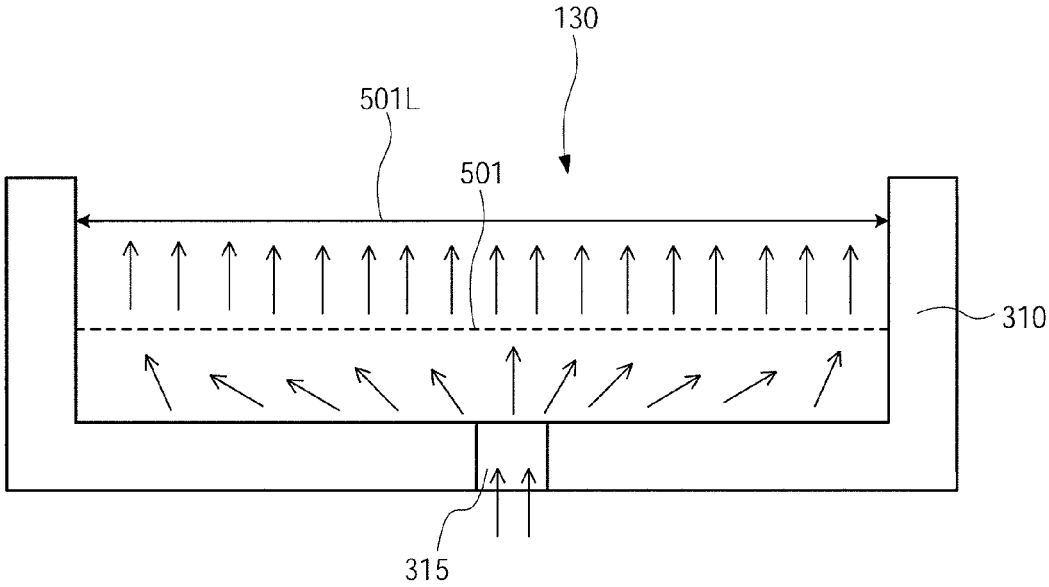
FIG. 13 is a partial enlarged view of a cross-section of a wiping apparatus of Embodiment 5.

FIG. 13 is an enlarged view of diffuser plate 501. As shown in FIG. 13, gas is supplied non-uniformly inside gas injection aperture 130 from gas supply port 315, but the distribution of gas inside gas injection aperture 130 is made uniform by diffuser plate 501.

The following simulations were performed to show that the distribution of gas inside gas injection aperture 130 is made uniform by diffuser plate 501. FLUENT (ANSYS Japan K.K.) was used as a simulation program.

In the simulations, length 501L of diffuser plate 501 was assumed to be 1 m, and the placement pitch of holes in the center of diffuser plate 501 (in the vicinity of gas supply port 315) was assumed to be ½ of the placement pitch of holes at the edge of diffuser plate 501 (in the vicinity of housing 310).

The simulation results showed that, taking the gas flow rate at center 130*c* of gas injection aperture 130 to be 1, the gas flow rate at edges 130*e* (areas within 30 mm from the ends) of gas injection aperture 130 could be kept to within 0.8 to 0.9, and, likewise, the proportion of the gas flow rate in areas between center 130*c* and edges 130*e* of gas injection aperture 130 could be kept to within 0.9 to 1.

EXAMPLE

Example 1

In example 1, an example will be described in which a nozzle plate is wiped by wiping apparatus 100 of Embodiment 1 illustrated in FIGS. 6 through 8.

(Wiping Apparatus Dimensions)

Curvature radius 112 of curved surface 111 was set at 10 mm, and the length of chord 113 of the curved surface was set at 5 mm. Width 131 of the slit that is gas injection aperture 130 was set at 0.4 mm. Angle of incidence θ of gas with respect to curved surface 111 was set at 71° (19° with respect to the horizontal plane) (see FIG. 6B).

(Wiping Conditions)

An ink drop approximately 3 mm in diameter was made to adhere to the surface of the nozzle plate beforehand. The angle of contact of the ink on the nozzle plate was approximately 50°. Then the wiping apparatus was moved relative to the nozzle plate while injecting air from the gas injection aperture. The flow rate of air injected from the gas injection aperture was set at 25 m/s, and the speed of movement of the wiping apparatus was set at 10 mm/s. Distance D1 between curved surface 111 and nozzle plate 11 was then changed within a range of 0.5 to 1.5 mm (see FIG. 8B). Then the wiping performance of wiping apparatus 100 (the size of ink drop 305 remaining on the nozzle plate) was evaluated.

(Results)

When distance D1 was 1.5 mm, an ink drop with a diameter of 0.35 mm at a maximum remained on the nozzle plate. When distance D1 was 1.0 mm, an ink drop with a diameter of 0.28 mm at a maximum remained on the nozzle plate. When distance D1 was 0.7 mm, an ink drop with a diameter of 0.16 mm at a maximum remained on the nozzle plate. And when distance D1 was 0.5 mm or less, the ink drop was completely removed from the nozzle plate.

Also, it was confirmed that wiping performance does not decrease even at the edges of the nozzle plate. These results suggest that a wiping apparatus of the present invention can form a stable gas flow along a curved surface by means of a Coanda effect irrespective of the shape (step or gap) of the nozzle plate.

Example 2

In example 2, a nozzle plate was wiped under the same conditions as in example 1, except that width 131 of the slit that is gas injection aperture 130 was set at 0.8 mm.

(Results)

When width 131 of the slit that is gas injection aperture 130 was 0.8 mm, an ink drop was completely removed from the nozzle plate when distance D1 was 1.0 mm or less.

Example 3

In example 3, a nozzle plate was wiped under the same conditions as in example 1, except that the flow rate of air injected from gas injection aperture 130 was set at 50 m/s.

(Results)

When the flow rate of air injected from gas injection aperture 130 was 50 m/s, an ink drop was completely removed from the nozzle plate when distance D1 was 1.0 mm or less.

Example 4

In example 4, a nozzle plate was wiped under the same conditions as in example 1, except that angle of incidence θ of gas with respect to curved surface 111 was set at 60° (30° with respect to the horizontal plane) (see FIG. 6B).

(Results)

When the injection angle of gas from gas injection aperture 130 was 30° with respect to the horizontal plane, an ink drop was completely removed from the nozzle plate when distance D1 was 0.5 mm or less.

The results of examples 1 through 4 are summarized in Table 1.

TABLE 1

| | Condition | Distance D1 at which ink drop was completely removed |
|---|---|---|
| example 1 | Gas flow rate: 25 m/s<br>Injection aperture width: 0.4 mm<br>Injection angle: 71° | 0.5 mm |

TABLE 1-continued

| | Condition | Distance D1 at which ink drop was completely removed |
|---|---|---|
| example 2 | Gas flow rate: 25 m/s<br>Injection aperture width: 0.8 mm<br>Injection angle: 71° | 1.0 mm |
| example 3 | Gas flow rate: 50 m/s<br>Injection aperture width: 0.4 mm<br>Injection angle: 71° | 1.0 mm |
| example 4 | Gas flow rate: 25 m/s<br>Injection aperture width: 0.4 mm<br>Injection angle: 60° | 0.5 mm |

The results of examples 1 through 4 suggest that desired wiping performance can be obtained by appropriate control of the angle of a gas injection aperture, and the flow rate of air supplied, according to the ink to be removed and equipment constraints.

Example 5

In example 5, an example will be described in which a nozzle plate is wiped by the wiping apparatus of Embodiment 2 shown in FIG. 9.

In example 5, a nozzle plate was wiped under the same conditions as in example 1, except that gas suction aperture 150 was provided, and distance D1 between curved surface 111 and nozzle plate 11 was set at 1 mm. Width 151 of gas suction aperture 150 was set at 0.4 mm (see FIG. 9).

(Results)

When width 151 of gas suction aperture 150 was 0.4 mm, ink drops 15 that were blown away also adhered to the upper surface of gas suction aperture 150, and the gas suction aperture could not collect all ink drops 306. This may be due to the fact that the width of the gas flow on the gas suction aperture 150 side of curved surface 111 increased to approximately 1.0 mm.

Example 6

In example 6, a nozzle plate was wiped under the same conditions as in example 5, except that width 151 of gas suction aperture 150 was set at 1.2 mm, and the injection angle of gas from gas injection aperture 130 was set at 30° with respect to the horizontal plane.

(Results)

When width 151 of gas suction aperture 150 was 1.2 mm, and the injection angle of gas from gas injection aperture 130 was 30° with respect to the horizontal plane, all ink drops 15 that were blown away were sucked in by gas suction aperture 150.

This result suggests that, it is possible to collect ink drops 15 that have been blown away more dependably, by making the width of the gas suction aperture larger than the width of the gas injection aperture.

Example 7

In example 7, an example will be described in which a nozzle plate is wiped using the wiping apparatus of Embodiment 4 shown in FIG. 11.

(Wiping Apparatus Dimensions)

Here, $\phi 1$, $\phi 2$, $\delta 1$, and $\delta 2$ in FIG. 11B were set as shown below. $\phi 1=19°$, $\phi 2=30°$, $\delta 1=\delta 2=90°$ Width 131 of gas injection aperture 130 was set at 0.4 mm, and the injection angle of gas from gas injection aperture 130 was set at 19° with respect to the horizontal plane. Width 151 of gas suction aperture 150 was set at 1.2 mm, and the suction angle of gas into gas suction aperture 150 was set at 30° with respect to the horizontal plane.

(Wiping Conditions)

A nozzle plate was wiped under the same conditions as in example 1, except that the flow rate of air injected from the gas injection aperture was set at 25 m/s, the flow rate of air sucked into the gas suction aperture was set at 50 m/s, and distance D1 between curved surface 111 and nozzle plate 11 was set at 1 mm.

(Results)

It was confirmed that a gas flow toward opening section 312 was created between parallel portion 411 and nozzle plate 11, and a gas flow toward opening section 312 was created between parallel portion 413 and nozzle plate 11. Also, the manner in which ink drops 15 are conveyed to opening section 312 by this gas flow, and finally are blown away by gas guided along curved surface 111 and are sucked into gas suction aperture 150, was confirmed.

INDUSTRIAL APPLICABILITY

A wiping apparatus of the present invention can wipe a material to be wiped in a contactless manner, irrespective of the shape of the material to be wiped, and without causing ink inside a nozzle to dry. A wiping apparatus of the present invention can be used for wiping of an ink-jet head, a slit die head, and a head of a multi-nozzle dispenser coating apparatus or the like.

REFERENCE SIGNS LIST

| | |
|---|---|
| 10 | Ink-jet head |
| 11 | Nozzle plate |
| 13 | Nozzle aperture |
| 15 | Ink |
| 100, 200, 300, 400, 500 | Wiping apparatus |
| 110 | Guide section |
| 111 | Curved surface |
| 130 | Gas injection aperture |
| 131 | Width of gas injection aperture |
| 150 | Gas suction aperture |
| 151 | Width of gas suction aperture |
| 310 | Housing |
| 311 | Injection aperture plate |
| 312 | Opening section |
| 313 | Suction aperture plate |
| 315 | Gas inlet |
| 317 | Gas outlet |
| 411 | Parallel portion of injection aperture plate |
| 413 | Parallel portion of suction aperture plate |
| 501 | Diffuser plate of gas injection aperture |
| 503 | Diffuser plate of gas suction aperture |

The invention claimed is:

1. A wiping apparatus comprising:

a guide that has a convexly curved surface which has an apex, an injection aperture plate and a suction aperture plate provided near the guide member spaced from each other and configured to have an opening above the apex of the curved surface to expose a top line of the convexly curved surface to the outside through the opening, and parallel portions extending substantially parallel to a nozzle plate are provided near the opening of the surfaces of the injection aperture plate and the suction aperture plate;

a gas injection aperture provided between the convexly curved surface of the guide member and the injection aperture plate that injects gas onto the convexly curved surface; and a gas suction aperture provided between the convexly curved surface of the guide section and the suction aperture plate, wherein a foreign substance adhering to the nozzle plate of an ink-jet head positioned above the guide is blown away by the gas guided along the curved surface of the guide.

2. The wiping apparatus according to claim 1, wherein a curvature radius of the curved surface is 5 to 200 millimeters.

3. The wiping apparatus according to claim 1, wherein an angle of incidence of the gas injected from the gas injection aperture with respect to the curved surface is 30 to 90 degrees.

4. The wiping apparatus according to claim 1, wherein:

the curved surface is a convex cylindrical surface having a top line; and the gas injection aperture is a slit having a longitudinal axis extending parallel to the top line of the curved surface.

5. The wiping apparatus according to claim 1, said gas suction aperture sucks in the foreign substance that is blown away, wherein the gas suction aperture and the gas injection aperture face each other across the guide.

6. The wiping apparatus according to claim 5, wherein:

the curved surface is a convex cylindrical surface having a top line;

the gas injection aperture is a slit having a longitudinal axis parallel to the top line of the curved surface; and the gas suction aperture is a slit having a longitudinal axis parallel to the top line of the curved surface.

7. The wiping apparatus according to claim 6, further comprising a housing that houses the guide, wherein:

the housing comprises:

the injection aperture plate and the suction aperture plate form a roof of the housing; and the gas injection aperture is a gap between the curved surface and the injection aperture plate; and the gas suction aperture is a gap between the curved surface and the suction aperture plate.

8. The wiping apparatus according to claim 1, further comprising a diffuser plate that distributes the gas inside the gas injection aperture.

9. An ink-jet apparatus comprising a wiping apparatus according to claim 1.

10. A nozzle plate wiping method comprising:

providing a wiping apparatus according to claim 1;

placing an ink-jet head above the wiping apparatus so that the curved surface and the nozzle plate are facing each other; and injecting gas from the gas injection aperture, moving the wiping apparatus relative to the nozzle plate while maintaining a fixed distance between the curved surface and the nozzle plate, and blowing away foreign substance adhering to the nozzle plate by gas guided along the curved surface.

11. The wiping method according to claim 10, wherein a flow rate of the gas injected from the gas injection aperture is equal to or greater than 15 meters per second.

12. The wiping method according to claim 10, wherein a distance between the curved surface and the nozzle plate is 0.2 to 1.5 millimeters.

13. The wiping apparatus according to claim 1, wherein at least one of the parallel portions is lyophilic.

14. The wiping apparatus according to claim 1, a first surface of said injection aperture plate comprising one of said parallel portions, a second surface of said injection aperture plate defining said gas injection aperture, a first surface of said suction aperture plate comprising another one of said parallel portions and a second surface said suction aperture plate defining said gas suction aperture.

15. The wiping apparatus according to claim 1, said gas injection aperture been configured to inject an ink solvent vapor gas.

* * * * *